US009411254B2

(12) United States Patent
Kawahara et al.

(10) Patent No.: US 9,411,254 B2
(45) Date of Patent: Aug. 9, 2016

(54) CHARGING DEVICE WITH CHARGING AND CLEANING MEMBERS

(71) Applicant: FUJI XEROX CO., LTD., Tokyo (JP)

(72) Inventors: Ichiro Kawahara, Yokohama (JP); Mikio Yamaguchi, Yokohama (JP); Hirofumi Iida, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/031,649

(22) Filed: Sep. 19, 2013

(65) Prior Publication Data

US 2014/0294430 A1 Oct. 2, 2014

(30) Foreign Application Priority Data

Mar. 27, 2013 (JP) ..... 2013-065301

(51) Int. Cl.
*G03G 15/02* (2006.01)

(52) U.S. Cl.
CPC ..... *G03G 15/0225* (2013.01)

(58) Field of Classification Search
CPC ..... G03G 15/0225
USPC ..... 399/100, 176, 101
See application file for complete search history.

(56) References Cited

U.S. PATENT DOCUMENTS

| | | | | |
|---|---|---|---|---|
| 4,382,673 | A * | 5/1983 | Nakajima | G03G 15/1685 399/101 |
| 2011/0170896 | A1 | 7/2011 | Yamaguchi | |
| 2011/0236052 | A1 * | 9/2011 | Takagi et al. | 399/100 |

FOREIGN PATENT DOCUMENTS

| | | | | |
|---|---|---|---|---|
| JP | A-5-297690 | | | 11/1993 |
| JP | H06-342237 | A | | 12/1994 |
| JP | A-8-62948 | | | 3/1996 |
| JP | A-2007-171381 | | | 7/2007 |
| JP | 2007-199266 | A | | 8/2007 |
| JP | A-2009-116373 | | | 5/2009 |
| JP | 2009-156904 | A | | 7/2009 |
| JP | 2010066708 | A | * | 3/2010 |
| JP | 2012032499 | A | * | 2/2012 |
| JP | 2012177733 | A | * | 9/2012 |
| JP | 2012181299 | A | * | 9/2012 |

OTHER PUBLICATIONS

Computer translations of JP2009-156904A, published Jul. 16, 2009 to Wada and JP2007-199266A, published Aug. 9, 2009 to Honobe et al.*

Sep. 1, 2015 Office Action issued in Japanese Application No. 2013-065301.

* cited by examiner

*Primary Examiner* — Quana M Grainger

(74) *Attorney, Agent, or Firm* — Oliff PLC

(57) ABSTRACT

A charging device includes a charging member and a cleaning member. The charging member is driven and rotated while in contact with an outer peripheral surface of an image carrier which rotates, and charges the image carrier. The cleaning member is driven and rotated while in contact with an outer peripheral surface of the charging member and cleans the outer peripheral surface of the charging member. In the charging device, a radius of the charging member is less than a radius of the cleaning member.

8 Claims, 7 Drawing Sheets

FRICTION FORCE f1 = N1 – N0

FRICTION FORCE f1 = N1 – N0

FRICTION FORCE f2 = N3 – N2

FRICTION FORCE f2 = N3 – N2

CHARGING DEVICE WITH CHARGING AND CLEANING MEMBERS

CROSS-REFERENCE TO RELATED APPLICATIONS

This application is based on and claims priority under 35 USC 119 from Japanese Patent Application No. 2013-065301 filed Mar. 27, 2013.

BACKGROUND (i) Technical Field

The present invention relates to a charging device, an assembly, and an image forming apparatus.

(ii) Related Art

An image forming apparatus such as a copying machine or a printer uses a charging device that charges an image carrier on which an electrostatic latent image is formed.

SUMMARY

According to an aspect of the invention, there is provided a charging device including a charging member and a cleaning member. The charging member is driven and rotated while in contact with an outer peripheral surface of an image carrier which rotates, and charges the image carrier. The cleaning member is driven and rotated while in contact with an outer peripheral surface of the charging member and cleans the outer peripheral surface of the charging member. In the charging device, a radius of the charging member is less than a radius of the cleaning member.

BRIEF DESCRIPTION OF THE DRAWINGS

An exemplary embodiment of the present invention will be described in detail based on the following figures, wherein.

DETAILED DESCRIPTION

An exemplary charging device, an exemplary assembly, and an exemplary image forming apparatus according to an exemplary embodiment are hereunder described on the basis of the drawings.

Figure 1:
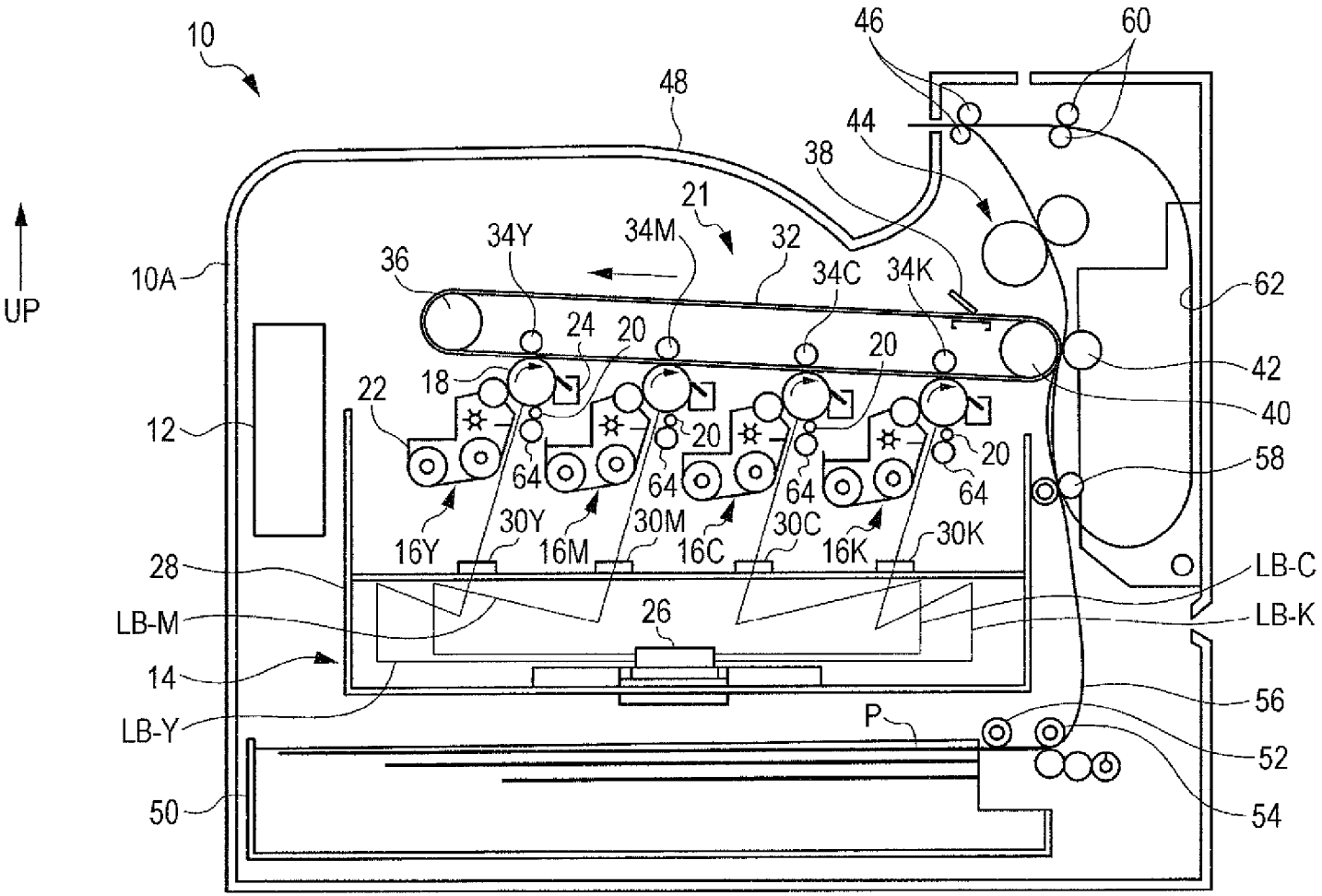
FIG. 1 is a schematic view of a structure of an image forming apparatus according to an exemplary embodiment.
Figure 2:
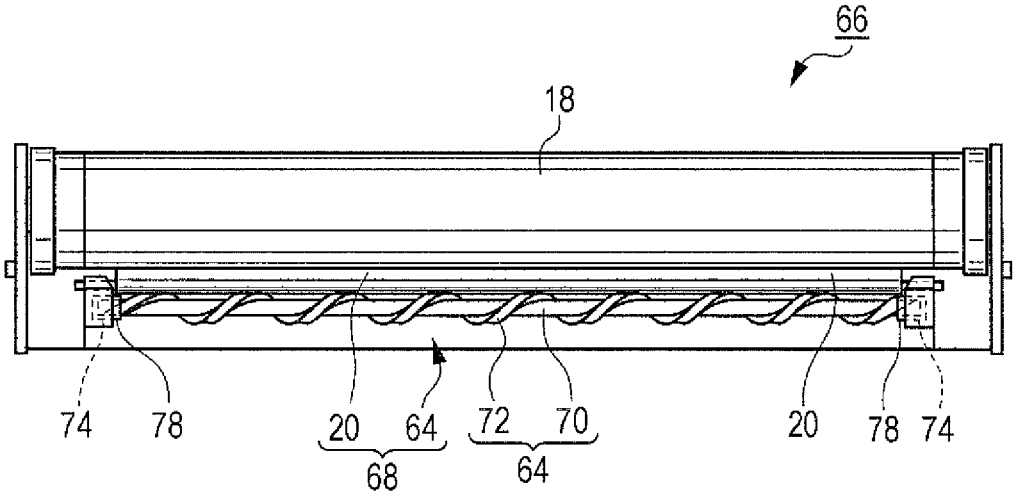
FIG. 2 is a schematic front view of a replacement cartridge.
Figure 3:
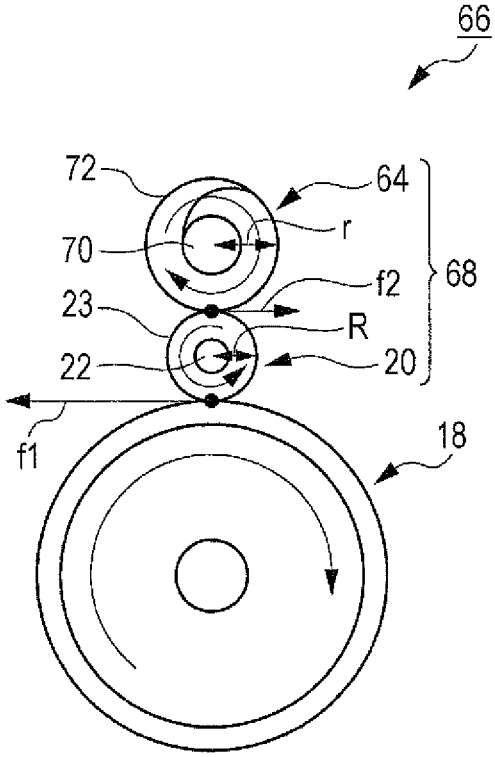
FIG. 3 is a schematic sectional view of the replacement cartridge.
Figure 4:
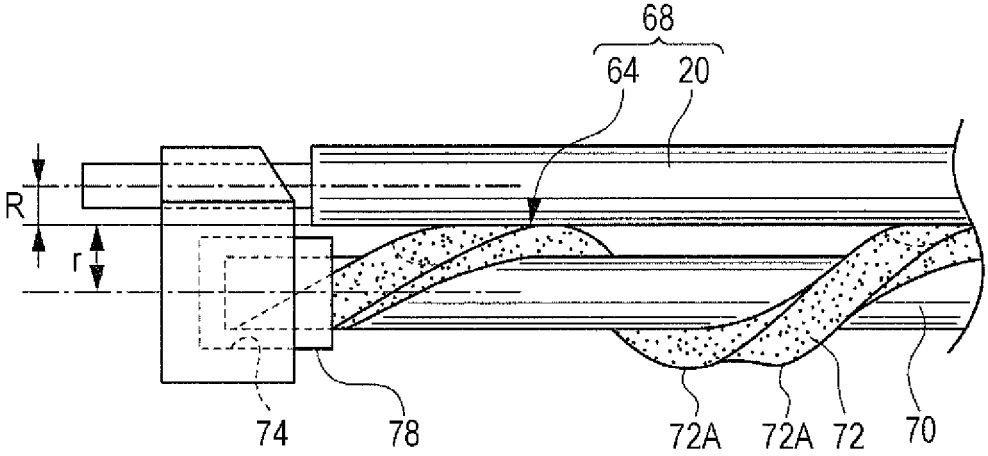
FIG. 4 is a partial enlarged schematic view of a charging device.

FIG. 1 is a schematic view of a structure of an image forming apparatus 10 according to an exemplary embodiment. An arrow UP shown in FIG. 1 indicates an upward direction (vertical direction). FIG. 2 is a schematic front view of a replacement cartridge 66 serving as an exemplary assembly. FIG. 3 is a schematic sectional view of the replacement cartridge 66. FIG. 4 is a partial enlarged schematic view of a charging device 68.

In FIG. 1, an image processing section 12 that performs image processing on image data that is input is provided in an internal portion of a body 10A of the image forming apparatus 10.

The image processing section 12 processes the input image data into pieces of gradation data of four colors, yellow (Y), magenta (M), cyan (C), and black (K). An exposure device 14 that receives the processed gradation data, and that performs image exposure using laser beams LB is provided in the center of the interior of the body 10A.

Four image forming units 16Y, 16M, 16C, and 16K corresponding to yellow (Y), magenta (M), cyan (C), and black (K) are disposed above the exposure device 14 so as to be spaced apart from each other in a horizontal direction. When the image forming units 16Y, 16M, 16C, and 16K need not be distinguished by color, the reference characters Y, M, C, and K are omitted.

These four image forming units 16Y, 16M, 16C, and 16K all have the same structure. These four image forming units 16Y, 16M, 16C, and 16K each include a columnar image carrier 18 that is rotationally driven at a predetermined speed; a first charging member 20 that charges an outer peripheral surface of the image carrier 18; a developing device 22 that develops an electrostatic latent image (formed on the outer peripheral surface of the image carrier 18 that is charged by the aforementioned image exposure by the exposure device 14) using toner of a predetermined color, to make visible the electrostatic latent image as a toner image; and a cleaning blade 24 that cleans the outer peripheral surface of the image carrier 18. A cleaning member 64 that is driven and rotated while in contact with the outer peripheral surface of the associated columnar charging member 20 and that cleans the outer peripheral surface of the associated charging member 20 is provided on the lower side of the associated charging member 20.

In FIG. 2, each charging device 68 includes the associated cleaning member 64 and the associated charging member 20 that constitutes the corresponding image forming unit 16 shown in FIG. 1. Each replacement cartridge 66 serving as an exemplary assembly includes the associated image carrier 18, the associated charging member 20, and the associated cleaning member 64. Each replacement cartridge 66 is replaceable with respect to the body 10A.

Here, the outer peripheral surface of each image carrier 18 and its associated charging member 20 contact each other, and each charging member 20 is driven and rotated by the rotation of its associated image carrier 18.

Each charging device 68 is described in detail below.

The exposure device 14 is provided with four semiconductor lasers (not shown) having a common structure for the four image forming units 16Y, 16M, 16C, and 16K. These semiconductor lasers emit laser beams LB-Y, LB-M, LB-C, and LB-K in accordance with the pieces of gradation data.

The laser beams LB-Y, LB-M, LB-C, and LB-K that are emitted from the associated semiconductor lasers illuminate a rotating polygon mirror 26 via an f-O lens (not shown), and are deflected by the rotating polygon mirror 26 and used for scanning. The laser beams LB-Y, LB-M, LB-C, and LB-K deflected by the polygon mirror 26 and used for the scanning obliquely scan and expose exposure points on the associated image carriers 18 from therebelow via an imaging lens and mirrors (not shown).

Since the exposure device 14 scans and exposes images on the associated image carriers 18 from therebelow, for example, toner may drop onto the exposure device 14 from, for example, the developing devices 22 of the four image forming units 16Y, 16M, 16C, and 16K that are positioned above the exposure device 14. Therefore, a portion around the exposure device 14 is hermetically sealed by a rectangular parallelepiped frame 28. In addition, transparent windows 30Y, 30M, 30C, and 30K, formed of glass, are provided at a top portion of the frame 28 for transmitting the four laser beams LB-Y, LB-M, LB-C, and LB-K to the image carriers 18 of the associated image forming units 16Y, 16M, 16C, and 16K.

A first transfer unit 21 is provided above the image forming units 16Y, 16M, 16C, and 16K. The first transfer unit 21 includes an endless intermediate transfer belt 32, a driving roller 40, a tension applying roller 36, a cleaning blade 38, and first transfer rollers 34Y, 34M, 34C, and 34K. The intermediate transfer belt 32 is wound upon the driving roller 40. The driving roller 40 is rotationally driven and circulates the intermediate transfer belt 32 in the direction of an arrow. The intermediate transfer belt 32 is also wound upon the tension applying roller 36. The tension applying roller 36 applies tension to the intermediate transfer belt 32. The cleaning blade 38 cleans an outer peripheral surface of the intermediate transfer belt 32. The first transfer rollers 34Y, 34M, 34C, and 34K are disposed opposite to the associated image carriers 18Y, 18M, 18C, and 18K with the intermediate transfer belt 32 being nipped therebetween.

Toner images of corresponding colors, yellow (Y), magenta (M), cyan (C), and black (K), which have been successively formed on the image carriers 18 of the image forming units 16Y, 16M, 16C, and 16K are transferred to the intermediate transfer belt 32 so as to be superimposed upon each other by the four first transfer rollers 34Y, 34M, 34C, and 34K.

A second transfer roller 42 is provided opposite to the driving roller 40 with the intermediate transfer belt 32 being nipped therebetween. The toner images of the corresponding colors, yellow (Y), magenta (M), cyan (C), and black (K), which have been transferred to the intermediate transfer belt 32 so as to be superimposed upon each other are transported by the intermediate transfer belt 32, and are second-transferred to a sheet material P serving as an exemplary recording medium that is nipped by the driving roller 40 and the second transfer roller 42 and that is transported along a sheet transport path 56.

A fixing device 44 that fixes the toner images transferred to the sheet material P to the sheet material P by heat and pressure is provided downstream of the second transfer roller 42 in the direction of transport of the sheet material P (hereunder simply referred to as "downstream").

Discharge rollers 46 are provided downstream of the fixing device 44. The discharge rollers 46 discharge the sheet material P to which the toner images are fixed to a discharge section 48 that is provided at a top portion of the body 10A of the image forming apparatus 10.

A sheet-feed member 50 in which sheet materials P are stacked is provided at a lower side of the interior of the body 10A of the image forming apparatus 10. A sheet-feed roller 52 that sends out sheet materials P that are stacked in the sheet-feed member 50 to the sheet transport path 56 is provided. A separation roller 54 that transports the sheet materials P by separating them one by one is provided downstream of the sheet-feed roller 52. A positioning roller 58 that adjusts a transport timing is provided downstream of the separation roller 54. Therefore, a sheet material P supplied from the sheet-feed member 50 is sent out to a position where the intermediate transfer belt 32 and the second transfer roller 42 contact each other (that is, a second transfer position) by the positioning roller 58 that rotates at a predetermined timing.

Further, transport rollers 60 are provided next to the discharge rollers 46. The transport rollers 60 transport the sheet material P to whose one surface images are fixed by the fixing device 44 to a duplex-printing transport path 62 without the sheet material P being discharged onto the discharge section 48 by the discharge rollers 46. This causes the sheet material P that is transported along the duplex-printing transport path 62 to be transported again to the positioning roller 58 with the front and back surfaces of the sheet material P reversed. Then, toner images are transferred and fixed to the back surface of the sheet material P, and the sheet material P is discharged onto the discharge section 48.

In the image forming apparatus 10, images are formed on a sheet material P as follows.

First, pieces of gradation data of corresponding colors are successively output to the exposure device 14 from the image processing section 12. The laser beams LB-Y, LB-M, LB-C, and LB-K that are emitted from the exposure device 14 in accordance with the pieces of gradation data scan and expose the outer peripheral surfaces of the image carriers 18 that are charged by the associated charging members 20, so that electrostatic latent images are formed on the outer peripheral surfaces of the associated image carriers 18. The electrostatic latent images that are formed on the image carriers 18 are made visible as toner images of the corresponding colors, yellow (Y), magenta (M), cyan (C), and black (K), by the developing devices 22Y, 22M, 22C, and 22K.

The toner images of the corresponding colors, yellow (Y), magenta (M), cyan (C), and black (K), which are formed on the image carriers 18 are transferred to the circulating intermediate transfer belt 32 so as to be superimposed upon each other by the first transfer rollers 34 of the first transfer unit 21 that are disposed along the upper sides of the image forming units 16Y, 16K, 16C, and 16K.

Toner images of the corresponding colors that are transferred to the circulating intermediate transfer belt 32 so as to be superimposed upon each other are second-transferred to the sheet material P by the second transfer roller 42, the sheet material P being transferred to the sheet transport path 56 from the sheet-feed member 50 by the sheet-feed roller 52, the separation roller 54, and the positioning roller 58 at a predetermined timing.

The sheet material P to which the toner images are transferred is further transported to the fixing device 44. The toner images that are transferred to the sheet material P are fixed to the sheet material P by the fixing device 44, after which the discharge rollers 46 discharge the sheet material P onto the discharge section 48 that is provided at the top portion of the body 10A of the image forming apparatus 10.

Further, when images are to be formed on both surfaces of the sheet material P, the sheet material P to whose one surface images are fixed by the fixing device 44 are transported to the duplex-printing transport path 62 via the transport rollers 60 by switching the transport direction without the sheet material P being discharged onto the discharge section 48 by the discharge rollers 46. Then, the sheet material P is transported along the duplex-printing transport path 62, so that the front and back surfaces of the sheet material P are reversed and the sheet material P is transported again to the positioning roller 58. Then, the toner images are transferred and fixed to the back surface of the sheet material P, after which the discharge rollers 46 discharge the sheet material. P onto the discharge section 48.

The charging device 68 is described in detail below.

In FIGS. 2, 3, and 4, the cleaning member 64 extending in an axial direction of the charging member 20 is provided so as to oppose the charging member 20. The cleaning member 64 includes a columnar core member 70 and a foaming member 72. The core member 70 extends in the axial direction of the charging member 20. The foaming member 72 serving as an exemplary elastic member is disposed at an outer periphery of the core member 70 and is spirally wound around an outer peripheral surface of the core member 70 while in contact with the outer peripheral surface of the charging member 20. In the exemplary embodiment, the foaming member 72 is formed of, for example, a urethane resin foam material that is elastically deformable. For example, the foaming member 72 is secured to the outer peripheral surface of the core member 70 by using a double-sided tape (not shown).

Further, as shown in FIG. 4, cylindrical holding members 78 are provided at two end portions of the foaming member 72. The holding members 78 prevent the two end portions of the foaming member 72 from being separated from the core member 70 as a result of interposing the end portions of the foaming member 72 between the associated holding members 78 and the core member 70.

Two end portions of the cleaning member 64 are rotatably supported by bearing members 74 from outer sides of the holding members 78 that are provided at two end portions of the cleaning member 64. The bearing members 74 support the cleaning member 64 with the foaming member 72 being compressed by a predetermined amount at the outer peripheral surface of the charging member 20. By this structure, the cleaning member 64 is driven and rotated as the charging member 20 rotates by friction force that is generated between the foaming member 72 and the charging member 20.

In the charging device 68, the radius of the charging member 20 is less than the radius of the cleaning member 64.

More specifically, in FIGS. 3 and 4, if the radius of the charging member 20 is R and the radius of the cleaning member 64 is r (that is, the radius when the foaming member 72 is compressed against the charging member 20), an example of a combination of the radius R of the charging member 20 and the radius r of the cleaning member 64 is 3.5 mm for the radius R and 4.0 mm for the radius r. The radius R may be on the order of 3.0 mm.

These numbers are not particularly limited. In the cleaning member 64, these numbers are determined considering, for example, processing costs, processing precision, and ease of making the core member 70.

In addition, the charging member 20 is, for example, one in which charging rubber 23 is formed around the core member 22. The diameter of the core member 22 is also determined for the purpose of, for example, reducing costs by reducing the thickness of the charging rubber 23 that is expensive in addition to being determined, for example, by processing costs, processing precision, and ease of making the core member 22.

When the radius R of the charging member 20 is less than the radius r of the cleaning member 64, the peripheral speed of the charging member 20 that is driven and rotated by the rotation of the image carrier 18 is higher than that when the radius R of the charging member 20 is greater than or equal to the radius r of the cleaning member 64. Since the peripheral speed of the charging member 20 is increased at the position where the foaming member 72 and the outer peripheral surface of the charging member 20 contact each other, the cleaning member 64 that is driven and rotated by the rotation of the charging member 20 tends to slide with respect to the charging member 20. In addition, the larger the mass of the cleaning member 64, the more easily the cleaning member 74 slides with respect to the charging member 20 due to inertia.

In FIG. 3, when friction force f2 between the cleaning member 64 and the charging member 20 is less than friction force f1 between the charging member 20 and the image carrier 18, the cleaning member 64 tends to slide with respect to the charging member 20.

Figure 5A:
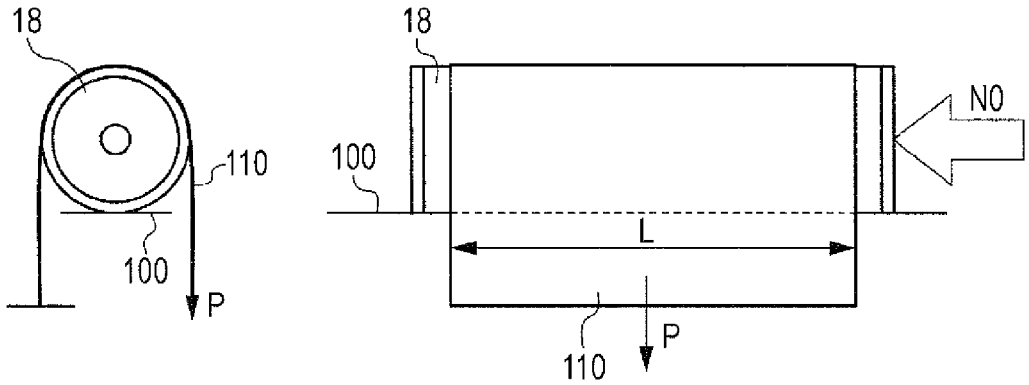
FIGS. 5A and 5B each show a method of measuring friction force f1.
Figure 5B:
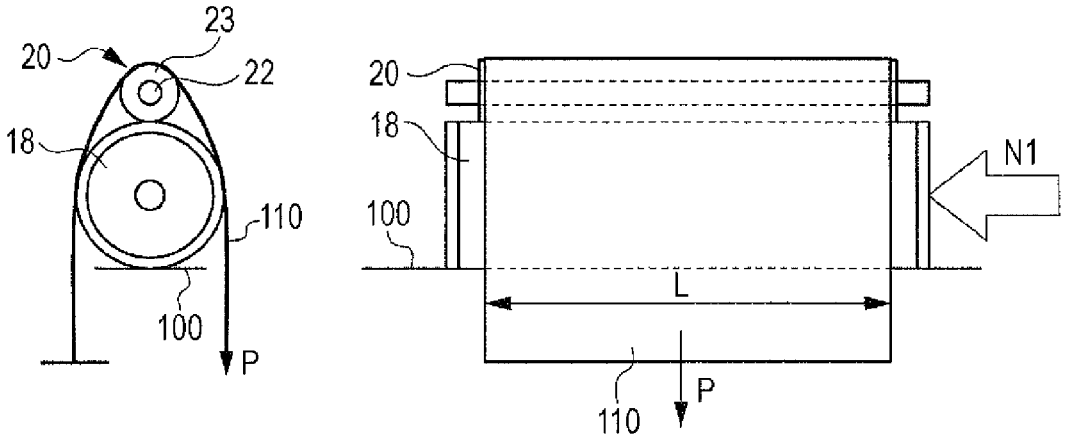
Figure 6A:
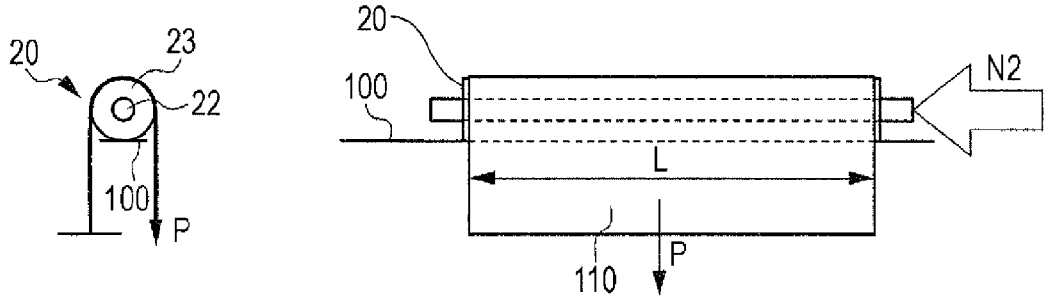
FIGS. 6A and 6B each show a method of measuring friction force f2.
Figure 6B:
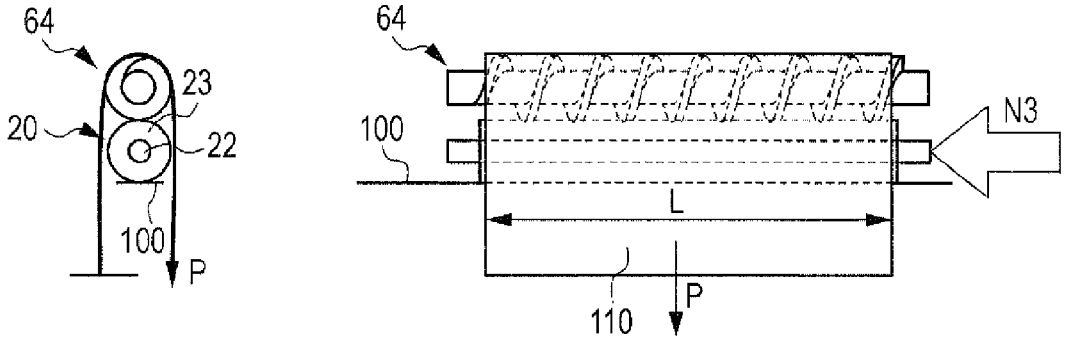

An exemplary method of measuring friction forces is illustrated in FIGS. 5A to 6B. FIGS. 5A and 5B each show a method of measuring the friction force f1. FIGS. 6A and 6B each show a method of measuring the friction force f2. FIGS. 5A and 5B are front views of the measuring method. FIGS. 6A and 6B are side views of the measuring method.

In FIG. 5A, the image carrier 18 is singly placed on a base 100. In addition, a polyethylene terephthalate (PET) film 110 having one end fixed and, for example, having a width L of the charging rubber 23 of the charging member 20 is wound so as to cover the image carrier 18, and a load P is applied to the other end. In this state, a push force that pushes the image carrier 18 from the axial direction (that is, the direction of an arrow) is measured.

When the force is static friction force, a force when the image carrier 18 starts moving is measured, whereas, when the force is kinetic friction, a force after the image carrier 18 starts moving is measured. For both the static friction force and kinetic friction force, the force that is measured at the single image carrier 18 is NO.

In FIG. 5B, the charging member 20 is placed on the image carrier 18 so that an axis of the image carrier 18 and an axis of the charging member 20 are vertically placed side by side with respect to the base 100. Similarly to the method shown in FIG. 5A, a polyethylene terephthalate (PET) film 110 having a width L of the charging rubber 23 of the charging member 20 is wound so as to cover the image carrier 18 and the charging member 20, and a load P is applied to the other end. In this state, a push force that pushes the image carrier 18 from the axial direction (that is, the direction of an arrow) is measured. The force in this case is N1.

Using the measured N1 and N0 , the friction force f1 between the charging member 20 and the image carrier 18 is determined by f1=N1−N0.

In FIG. 6A, using a method that is similar to the method shown in FIG. 5A, a push force N2 that pushes the single charging member 20 in the axial direction (that is, in the direction of an arrow) is measured.

In FIG. 6B, using a method that is similar to the method shown in FIG. 5B, the charging member 20 and the cleaning member 64 are combined, and a push force N3 that pushes the charging member 20 from the axial direction (that is, in the direction of an arrow) is measured.

Using the measured N2 and N3 , the friction force f2 between the charging member 20 and the cleaning member 64 is determined by f2=N3 −N2.

In order to reduce the friction force f2 between the charging member 20 and the cleaning member 64, the foam density of the foaming member 72 is substantially 20 to 120 kg/m$^3$. When sponges having foam densities of 15, 20, 40, 50, 60, 70, 80, 90, 100, 120, 150, 180, and 200 kg/m$^3$ are formed into cylindrical rollers or spirally wound rollers, and the friction forces f1 and f2 are measured, the friction force f2 is reduced suddenly at a foam density that is less than or equal to 20 kg/m$^3$, and the cleaning member no longer rotates. At a foam density that is greater than or equal to 120 kg/m$^3$, the relationship becomes f2>f1, as a result of which an image failure occurs because the rotation of the charging member becomes unstable. A more desirable result is obtained when the foam density is on the order of from 50 to 90 kg/m$^3$.

An example and comparative examples are hereunder given, and changes in ratios between the number of rotations of a charging member 20 and the number of rotations of a cleaning member 64 when the printing speed is increased are compared with each other. Numerical values indicated below are examples, so that other numerical values may be used.

In the example, a cleaning member 64 whose radius r is 4.0 mm and the charging member 20 whose radius R is 3.5 mm are used.

The cleaning member 64 is one in which urethane foam member, which is an example of a foaming member 72, is spirally wound around a core member 70 whose radius is 2.0 mm at an angle of 25 degrees with respect to an axial direction. The thickness of the foaming member 72 is selected so that the radius r of the cleaning member 64 becomes 4.0 mm when the radius r of the foaming member 72 is that when it is compressed against the charging member 20. The thickness and width of the foaming member 72 are 2.5 mm and 6 mm, respectively.

Figure 7A:
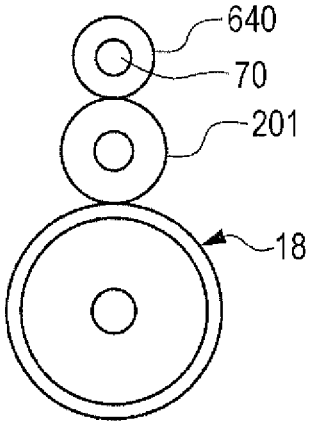
FIG. 7A is a schematic sectional view of a replacement cartridge according to a first comparative example.

FIG. 7A is a schematic sectional view of a replacement cartridge 66 according to a first comparative example. In the first comparative example, a cleaning member 64 in which the diameter r of a foaming member 72 formed around the entire peripheral surface of a core member 70 is 4.0 mm is used. A charging member 201 whose diameter R is 4.5 mm is also used.

Figure 7B:
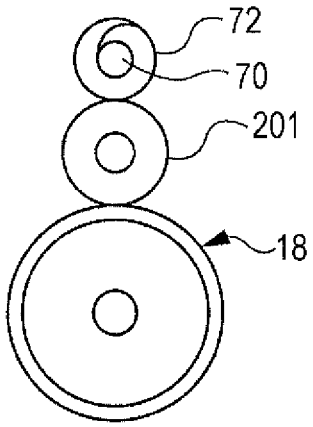
FIG. 7B is a schematic sectional view of a replacement cartridge according to a second comparative example.

FIG. 7B is a schematic sectional view of a replacement cartridge according to a second comparative example. In the second comparative example, a cleaning member 64 used in the example and whose diameter r is 4.0 mm is used. A charging member 201 whose diameter R is 4.5 mm is also used.

Using a laser interferometer, the number of rotations of the charging member 20 and the number of rotations of the cleaning member 64 are measured by changing the peripheral speed of an image carrier 18. More specifically, from the numbers of rotations (rpm) calculated by monitoring the position of a surface of each of the image carrier, the charging member, and the cleaning member for approximately 10 rotations, and from the outside diameter (mm) of each member, the peripheral speed (mm/s) is calculated. Methods of measuring the numbers of rotations are not limited to the above-described measuring method. The numbers of rotations may be measured by inserting a wire in each of the members.

Figure 8:
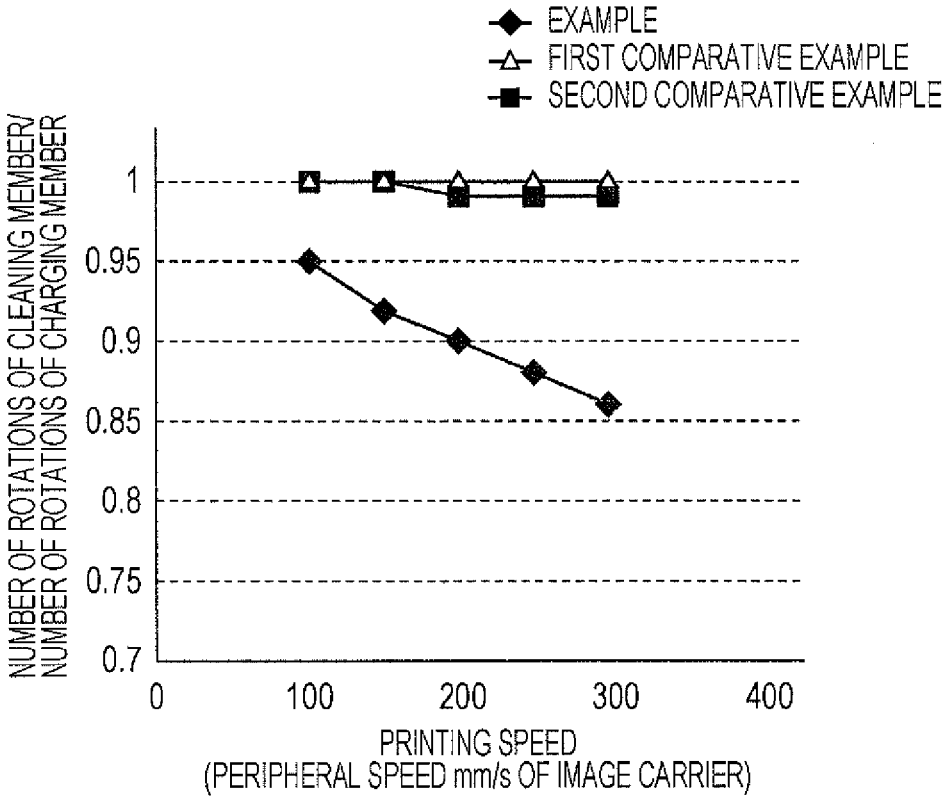
FIG. 8 is a plan view of a plate member according to a modification.

FIG. 8 gives the measurement results. The horizontal axis indicates the peripheral speed of the image carrier 18 that corresponds to the printing speed. The vertical axis indicates the ratio between the number of rotations of the cleaning member 64 and the number of rotations of the charging member 20 (that is, the number of rotations of the cleaning member 64/the number of rotations of the charging member 20). The measurement results show that the smaller the ratio, the cleaning member 64 slides with respect to the charging member 20.

In the first comparative example, even if the peripheral speed of the image carrier 18 is increased, there is almost no difference between the number of rotations of the charging member 20 and the number of rotations of the cleaning member 64. In the second comparative example, if the peripheral speed of the image carrier 18 is increased, the numbers of rotations start to differ from each other, and the cleaning member 64 starts sliding with respect to the charging member 20.

Therefore, it is understood that when the foaming member 72 is spirally wound around the core member 70 and contact resistance is reduced by reducing the contact area between the cleaning member 64 and the charging member 20, the cleaning member 64 starts sliding with respect to the charging member 20.

In contrast, it is understood that, in the example, when the cleaning member 64 starts sliding with respect to the charging member 20 from a state in which the peripheral speed of the image carrier 18 is low, the more the peripheral speed of the image carrier 18 is increased, the more noticeably the cleaning member 64 slides with respect to the charging member 20.

From this, it is understood that causing the radius R of the charging member 20 to be less than the radius r of the cleaning member 64 is highly effective in causing the cleaning member 64 to slide with respect to the charging member 20.

As shown in FIG. 1, toner images that are formed on the outer peripheral surfaces of the image carriers 18 that rotate are transferred to the intermediate transfer belt 32 that circulates. Then, any foreign material, such as toner, remaining on any of the outer peripheral surfaces of the image carriers 18 without being transferred to the intermediate transfer belt 32 is removed from the any of the outer peripheral surfaces of the image carriers 18 by the associated cleaning blade 24.

Here, any foreign material, such as an external additive included in developer and having a small particle size, moves past the cleaning blade 24. The foreign material, such as an external additive, that has moved past the cleaning blade 24, adheres to the outer peripheral surface of the charging member 20.

In FIG. 4, any foreign material, such as an external additive, adhered to the outer peripheral surface of the charging member 20 that rotates is wiped off from the outer periphery of the charging member 20 by the foaming member 72 as a result of sliding of the cleaning member 64 with respect to the charging member 20. This further enhances cleaning capability and further increases the life of the charging member.

When the cleaning member 64 slides more with respect to the charging member 20, end portions 72A of the spirally wound foaming member 72 of the cleaning member 64 scrape off any foreign material from the outer peripheral surface of the charging member 20, to further increase cleaning capability and further increase the life of the charging member.

Further, when the end portions 72A of the foaming member 72 each have a portion that protrudes beyond its central portion, each end portion 72A of the foaming member 72 of the cleaning member 64 that is driven and rotated is pushed against the outer peripheral surface of the charging member 20 and is elastically deformed (elastically compressed) in a height direction and a widthwise direction of the foaming member 72, so that each end portion 72A is pressed into the foaming member 72 and flocculates. Then, each end portion 72A of the foaming member 72 of the cleaning member 64 that is driven and rotated is brought out of contact with the charging member 20, so that each end portion 72A is elastically restored to its original state. This restoring force causes flocculated foreign material, such as an external additive, to be brought out of its dense state and repelled from the outer peripheral surface of the charging member 20.

This further enhances the cleaning capability of the cleaning member 64. Here, since the foaming member 72 is spirally disposed around the core member 70, the foaming member 72 is restored to its original state in the widthwise direction, so that a component force in the axial direction also acts upon the foreign material adhered to the charging member 20.

Part of the removed foreign material accumulates in an internal portion of the foaming member 72, and another part of the removed foreign material falls and is trapped in a foreign material chamber (not shown), which is provided below the cleaning member 64 in a downward (gravitation) direction. Any foreign material existing on the surface of the charging member 20 and brought out from the dense state may move to the image carrier 18 and may be collected by an image-carrier cleaning device (not shown).

The cleaning member 64 uniformly removes any foreign material, such as an external additive, adhered to the outer peripheral surface of the charging member 20, so that charging failure of the image carrier 18 is suppressed. Therefore, the quality of toner images that are formed on the image carriers 18 is increased.

By increasing the quality of the toner images that are formed on the image carriers 18, the quality of an output image that is formed on a sheet material P is increased.

An exemplary embodiment and examples according to the present invention are described in detail. However, the present invention is not limited to such an exemplary embodiment and examples. It is obvious to any person skilled in the art that other exemplary embodiments and examples are possible within the scope of the present invention.

Although, in the exemplary embodiment, a foaming member formed of an elastically deformable urethane resin, which is an exemplary elastic material serving as a material of the foaming member 72, is used, a foaming member formed of other materials, such as rubber materials, may also be used.

Although, in the exemplary embodiment, each replacement cartridge 66 is constituted by an image carrier 18, a charging member 20, and a cleaning member 64, each replacement cartridge 66 may also be constituted by an image carrier 18, a charging member 20, a cleaning member 64, and other additional structural components, such as a developing device.

What is claimed is:

1. A charging device comprising:

a charging member that is driven and rotated while in contact with an outer peripheral surface of an image carrier which rotates, and that charges the image carrier; and a cleaning member that is driven and rotated while in contact with an outer peripheral surface of the charging member and that cleans the outer peripheral surface of the charging member, the cleaning member including a foaming member disposed around a core member, wherein an outermost radius of the cleaning member as defined by a radially outermost surface of a contacting area of the foaming member is constant throughout an entire length of the cleaning member, and wherein a radius of the charging member is less than an outermost radius of the cleaning member when the foaming member is compressed against the charging member in the charging device.

2. The charging device according to claim 1, wherein the foaming member is a spirally wound elastic member that is disposed at an outer periphery of the core member and that contacts the outer peripheral surface of the charging member.

3. The charging device according to claim 1, wherein friction force between the cleaning member and the charging member is less than friction force between the charging member and the image carrier.

4. The charging device according to claim 2, wherein a foam density of the foaming member is substantially 20 to 120 $kg/m^3$.

5. An assembly comprising:

an image carrier; and the charging device according to claim 1, wherein the assembly is replaceably mounted with respect to a body.

6. An image forming apparatus comprising:

the assembly according to claim 5;

an exposure device that forms an electrostatic latent image by exposing the outer peripheral surface of the charged image carrier provided at the assembly; and a developing device that makes visible as an image the electrostatic latent image formed on the outer peripheral surface of the image carrier.

7. The charging device according to claim 1, further comprising:

a holding member provided at least at one end portion of the foaming member to prevent the one end portion of the foaming member from being separated from the core member.

8. The charging device according to claim 1, wherein the charging member includes a core member, and the core member of the cleaning member is a columnar core member, and wherein a radius of the core member of the charging member is less than a radius of the columnar core member of the cleaning member.

* * * * *